United States Patent [19]

MacGregor et al.

[11] Patent Number: 4,846,504

[45] Date of Patent: Jul. 11, 1989

[54] SECURE ON-PACK PROMOTIONAL COUPONS

[75] Inventors: John MacGregor, Hamilton, Ohio; Frank J. Welch, Whittier; Kenneth Lin, San Marino, both of Calif.

[73] Assignee: Avery International Corporation, Pasadena, Calif.

[21] Appl. No.: 238,564

[22] Filed: Aug. 30, 1988

[51] Int. Cl.[4] ..... B42D 15/00

[52] U.S. Cl. ..... 283/102; 283/81; 283/101; 283/97

[58] Field of Search ..... 283/56, 97, 81, 100, 283/101, 102

[56] References Cited

U.S. PATENT DOCUMENTS 1,985,834 12/1934 Lawrence .
2,223,106 11/1940 Humphner .
2,532,011 11/1950 Dahlquist et al. ..... 283/101 X
4,033,918 7/1977 Hauber .

FOREIGN PATENT DOCUMENTS 654529 12/1978 Fed. Rep. of Germany .

*Primary Examiner*—Paul A. Bell
*Attorney, Agent, or Firm*—Poms, Smith, Lande & Rose

[57] ABSTRACT

A label assembly includes concealed promotional material, and is secured to the product package with the assembly including water-soluble adhesive. The promotional material may be in the form of a "cents-off" coupon or a scratch-off lottery-type game piece. The use of water-soluble adhesive deters tampering prior to purchase of the product, and the coupon or game piece is subsequently exposed when the water soluble adhesive is washed away. The label assembly may include either one, two, or three layers, with the lowermost label being secured to a backing strip or web preparatory to application to the product. When a single layer is employed, it is opaque, and the promotional material is on its lower surface. In a three-layer unit, the game piece may be sandwiched between an outer label having water-soluble adhesive, and the base label which is provided with permanent pressure-sensitive adhesive.

20 Claims, 2 Drawing Sheets

SECURE ON-PACK PROMOTIONAL COUPONS

FIELD OF THE INVENTION

This invention relates to coupons or similar game pieces which are to be secured to a product for sale in a store, but which are intended to be removed after leaving the store, for example at home.

BACKGROUND OF THE INVENTION

Many companies use coupons or games of various sorts to promote the sale of their products. For example, coupons offering "___ CENTS OFF" are often seen in the newspapers, and some franchise stores give "scratch-off" game pieces with your purchase, to introduce new products, or for other promotional purposes. The game pieces characteristically include some cash prizes, and some merchandise or food prizes, sold by the franchise store or the product manufacturer.

Manufacturers would like to have the option of mounting such promotional coupons, including game pieces, on products sold in supermarkets, drugstores, and other outlets. However, using previously proposed coupon mounting arrangements, there would be the possibility or likelihood that the coupons would be detached from the product packages in the stores prior to purchase, in view of the lack of close supervision of customers in most supermarkets, large drug stores or similar establishments.

Concerning prior structural arrangements, it is well known that stamps and various types of labels may be removed by water, and F. W. Humphries U.S. Pat. No. 2,223,106 and J. B. Lawrence U.S. Pat. No. 1,985,834 show two stamp configurations intended to prevent re-use of stamps after removal using water. Swiss Patent No. CH 654,529 shows a double thickness lottery ticket assembly wherein the layer bearing the lottery number is concealed by an upper layer secured by adhesive around the edges of the assembly. Attention is also directed to R. Hauber U.S. Pat. No. 4,033,918, granted July 5, 1977 which discloses a label secured to a container by water soluble adhesive so that it may be easily removed by the user, to permit use of the container. However, no promotional information is involved, and the label of Hauber need not be waterproof or integral, as his purpose is to obtain a clean container, not to provide an integral coupon, such as a game piece.

However, none of these patents disclose a solution to the problem of providing secure on-pack promotional coupons, for use in stores and arranged to avoid tampering in the store.

SUMMARY OF THE INVENTION

In accordance with a broad aspect of the invention, a promotional coupon or game piece is formed of water-resistant material, and is secured to a product by water soluble adhesive, so that the purchaser of the product must run water over the label or coupon in order to expose the coupon or game piece and remove it from the product.

In view of the limited availability of water in stores, the use of water soluble adhesive, permanent until removed by water, will deter persons from removing or tampering with the labels prior to purchasing the products.

The secure on-pack promotional coupons may take a number of forms. In each case, the assembly will include printed material indicating the value of the coupon, or arrangements for exposing a game piece which will present the opportunity of winning a prize. The game piece may have a series of scratch-off areas, and matching of these areas in a predetermined manner may result in the awarding of a prize, by way of example. In addition, any type of computer printed variable game copy may of course be used.

The label assemblies may be formed of one, two or three layers, for examples, and are preferably initially mounted on a backing tape for application to products, as the backing tape is fed over a peeling blade, in accordance with conventional practice in applying labels.

In one embodiment where a three layer label is used, a permanent pressure-sensitive adhesive layer is coated on the bottom of the base sheet of the label assembly, and the backing tape or web, coated with the usual release layer, supports the label assembly. A "game piece" having a scratch-off area may be lightly adhered to the base sheet by a non-permanent, pressure-sensitive adhesive. This "game piece" or coupon may be concealed by a third outer label secured to the assembly by water soluble adhesive, for removal at home following purchase of the product.

The outer label may contain advertising which may be the same as that appearing on the base label.

Instead of a separate game piece, the outer label may be opaque, and printed with a coupon or with the "game piece" information on the inner surface thereof.

As a further alternative, only a single layer label may be used, with the coupon layer being opaque, printed on its concealed surface with promotional material (coupon or game piece), and secured directly to the container with water soluble adhesive. The water adhesive is preferably a "permanent", pressure-soluble sensitive, water-soluble adhesive. The label should be water resistant and integral, so that the promotional material may be removed without impairing the label.

In accordance with a method illustrating the principles of the present invention, a hot melt, water soluble, permanent pressure-sensitive adhesive may be employed. This adhesive is applied to rolls of printed label sheet stock, in a pattern to each label area, with the pattern being interrupted, both in the direction of movement of the label sheet stock, and transverse thereto. The label stock is then secured to a release coated backing web, and individual labels are formed from the label stock. Next, the labels are applied to product containers in a conventional manner; and finally, the labels are removed from the product containers by the application of water to the labels.

Other objects, features, and advantages will become apparent from a consideration of the following detailed description, and from the accompanying drawings.

DESCRIPTION OF PREFERRED EMBODIMENTS

Figure 1:
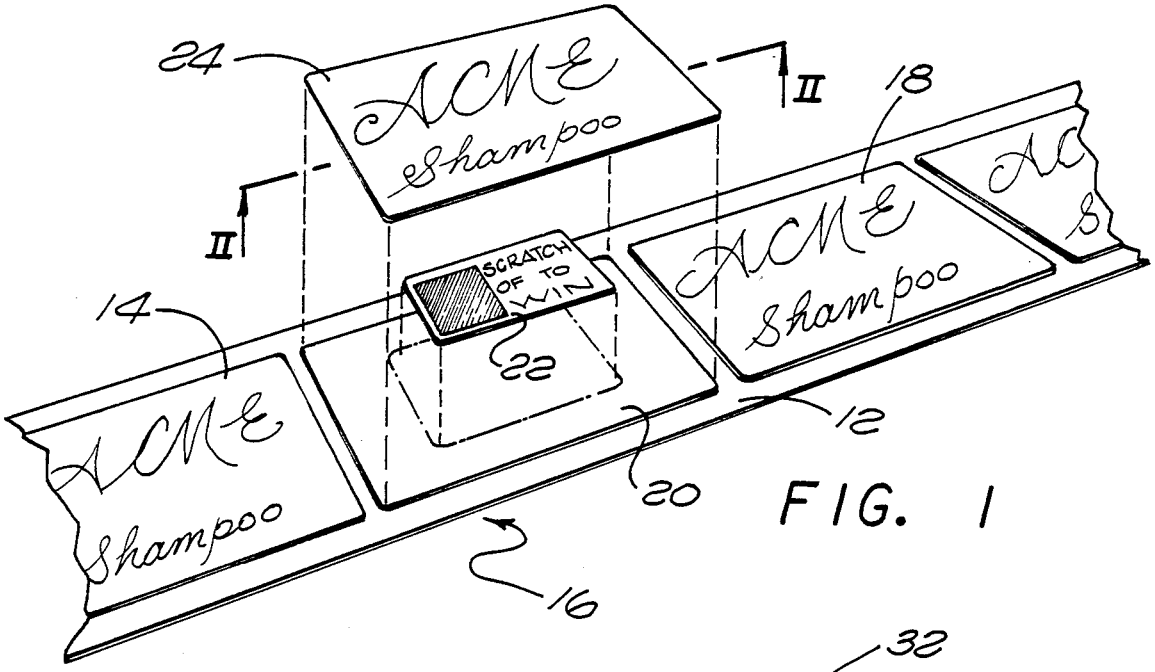
FIG. 1 is an exploded view of a series of labels illustrating the principles of the present invention, with the labels being mounted on a backing strip or web.

Referring now in detail to the drawings, FIG. 1 shows a backing tape or web 12 coated on its upper surface with a release layer, and bearing a series of labels 14, 16, and 18. As indicated by the exploded showing of label 16, each of the labels 14, 16 and 18 is formed of three parts, a base portion 20, an intermediate promotional portion 22, and an outer label portion 24. Now, considering the adhesive material which is employed in securing the portions 20, 22, and 24 together, and eventually to the product, the lower label 20 is provided with a coating on its lower surface, facing the web 12, of a permanent pressure-sensitive adhesive. The promotional label 22 is secured to the base label portion 20 by a transparent, non-tacky adhesive, which lightly adheres the label 22 to the base label 20. The lower surface of the top label 24 is provided with a pressure-sensitive, permanent, water soluble adhesive to secure the outer label portion 24, to the base portion 20 of the three thickness label 16.

Figure 5:
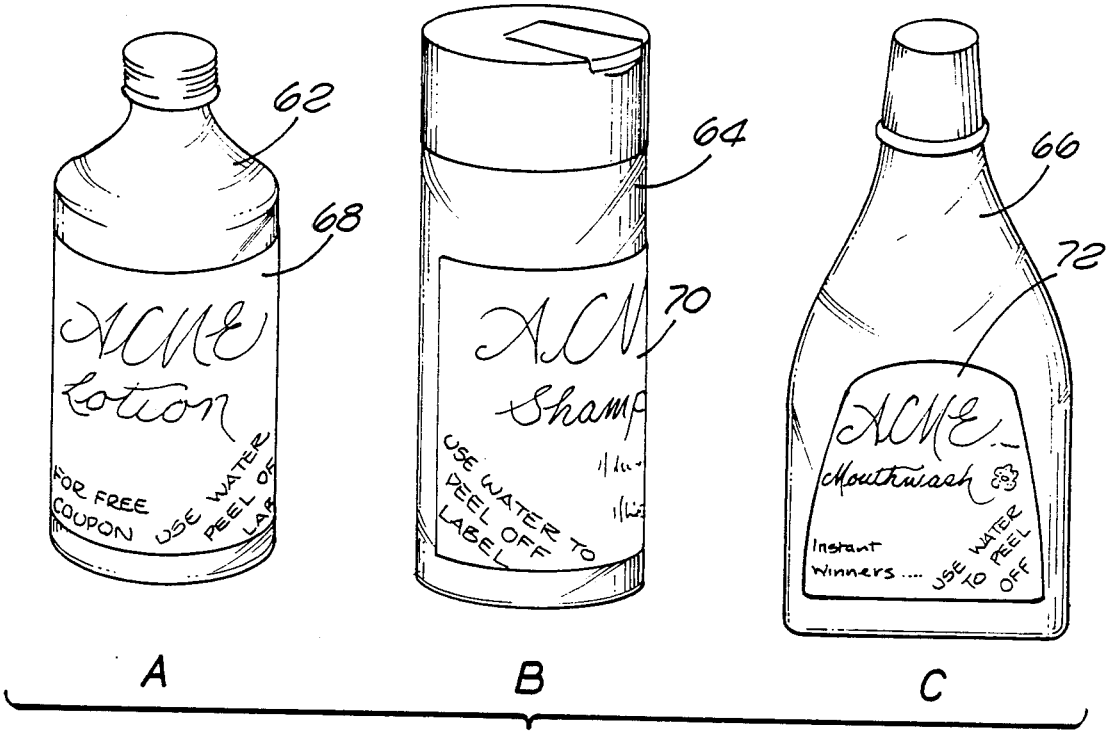
FIG. 5 shows three typical product containers upon which the labels may be placed.

In practice, the labels, once assembled on the backing tape or web 12, are applied to products such as those pictured at "A", "B", and "C" in FIG. 5, by passing the backing tape 12 over a peeling blade so that the label is freed from the backing web, and engages the product container, in accordance with known labeling practices.

The product is then marketed in stores, where the presence of the permanent water-soluble adhesive deters persons from removing the outer label 24, in view of the need to apply running water or to soak the label 24 in order to remove it and expose the promotional label 22. However, once the product is purchased and is in the user's home, the label 24 may be readily removed under running water, or by soaking, and the game piece or promotional coupon 22 may be removed from the base label 20 to which it is lightly adhered. The base label 20 is normally provided with advertising material or product information which may be similar to that on the outer label 24.

With regard to the types of adhesives and materials which may be employed, certain additional information may be helpful, in understanding the constructions. Thus, with regard to "permanent" pressure-sensitive adhesive, or self-adhesive material, using standard measuring techniques in accordance with Pressure-Sensitive Tape Council Standards, permanent adhesive normally has a peel force of three or four, or more, pounds per one inch strip, measured perpendicular to the orientation of the tape on a stainless steel base member. On the other hand, removable pressure-sensitive adhesives, or self-adhesive materials, normally have a peel force of less than about two pounds. Characteristically, with permanent adhesives, the label or the underlying base material will not maintain structural integrity and will come apart or be destroyed, rather than permitting the label to be peeled off. However, using removable or resealable pressure-sensitive adhesives, the label and the underlying product will normally retain their structural integrity as the label is being peeled back. Using full adhesive coverage, with a rubber base, hot melt, permanent adhesive, a peel force of approximately 4.5 pounds is obtained. This compares with the peel strength of approximately 3.0 pounds for a solvent-type permanent pressure-sensitive adhesive; and a solvent acrylic permanent adhesive may have a peel force of approximately 3.9 pounds; and a solvent-type removable adhesive may have a peel strength of approximately 0.7 pounds; a hot melt removable self-adhesive may have a peel strength of approximately 0.9 pounds; and a solvent based high strength adhesive could have a full coverage peel force of up to six pounds. Other types of adhesives including acrylic-based hot melt permanent adhesive could also be employed. Reference is made to co-pending U.S. patent application, Ser. No. 873,372, filed June 12, 1986, now U.S. Pat. No. 4,771,891, granted Sept. 20, 1988, for plots of peel force versus percentage coverage for one representative permanent pressure-sensitive adhesive.

Concerning the adhesive employed to secure the promotional layer 22 to the base layer 20, this may be accomplished with a coating which is transparent, and which lightly adheres the promotional layer 22 to the base label 20, but is non-tacky. A suitable coating for this purpose would be an emulsion latex polymer coating. It is transparent, non-tacky, peelable, and has low adhesion.

With regard to the water soluble permanent adhesive employed to secure the outer label 24, to the base label 20, this may be the adhesive disclosed in U.S. Pat. No. 4,492,724, issued Jan. 8, 1985, and assigned to the assignee of the present invention. Alternatively, a hot melt permanent water-soluble adhesive may be employed, instead of the water adhesive system of the foregoing cited patent. The hot melt water-soluble adhesive may be formed of polyethyleneoxazoline, available from the Dow Chemical Company under the trademark "PeOx".

Incidentally, as a method for lightly adhering the promotional intermediate label 22 to the base label 20, the label 22 may have a partial covering, such as a series of fine lines or dots of permanent adhesive secured to its lower surface, instead of the peelable adhesive. Use of fine lines or dots of adhesive a few thousandths of an inch wide, or in their cross-sectional dimension will serve the same purpose as the use of an adhesive having a weaker holding force, as set forth in U.S. patent application, Ser. No. 873,372, cited hereinabove. More generally, any type of removable adhesive could be used for securing these label layers together.

Concerning materials for each of the three label layers, the base label 20 and the intermediate promotional label22 should be formed of water-resistant material, so that when the upper or outer label 24 is removed by the application of water, the lower two labels are not adversely affected. Accordingly, these lower labels should be made of water-resistant paper or of film material which is not affected by water. Techniques are well known for making paper for use in labels water-resistant, and this may be accomplished by applying suitable impregnation, sizes, or coatings to the paper. Thus, the paper may be latex-impregnated, or may be provided with a barrier-resistant coating, such as varnish. Suitable plastic films which may be employed, include white polystyrene, sold under the trademark "OPTICITE", by Dow Chemical; or white polypropylene, sold under the trademark "KIMDURA", by Kimberly Clark. Similarly, a white polyethylene film is available which may be employed as the label material.

Figure 2:
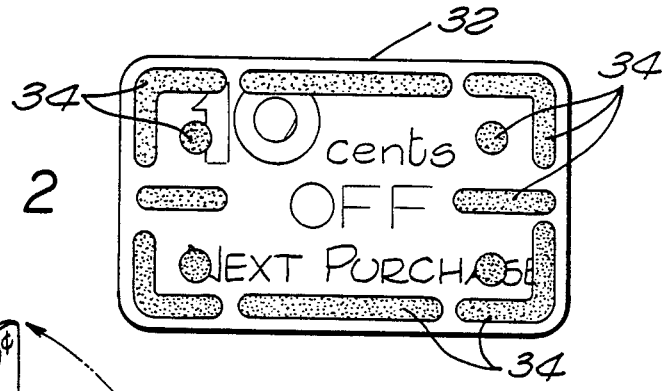
FIG. 2 is a bottom view of a label illustrating the principles of the invention, in which a pattern of water soluble adhesive is shown.

Returning now to the drawings, FIG. 2 shows a label 32 formed of opaque material, and having its lower side, as shown in FIG. 2, provided with a pattern of water-soluble adhesive 34. It may be noted that the pattern of water-soluble adhesive 34 provides spaces between the areas of adhesive for access by water, so that the entire under-surface of the label may be quickly exposed to the water and so that the adhesive may be quickly released. As mentioned above, patterns of the type shown in FIG. 2 are more readily applied using hot melt adhesive, and accordingly, such adhesives are preferred. The label of FIG. 2 may be employed as an individual label with no base label; or alternatively, it may be employed in combination with a base label which is permanently adhered to the product package, to provide an advertising or product message, even after the outer label containing the promotion in terms of a coupon or a game piece, have been removed. The top side of the label of FIG. 2, which is not shown, may have advertising material as indicated on the label 24 in FIG. 1. Incidentally, in the case of the label of FIG. 2, it should be formed of water-resistant material. In the case of the label 24 of FIG. 1, however, in cases where this upper label 24 has no promotional material on its underside, it may be formed of non-water resistant paper, as it would be of no concern, if it were destroyed as it is removed.

Figure 3:
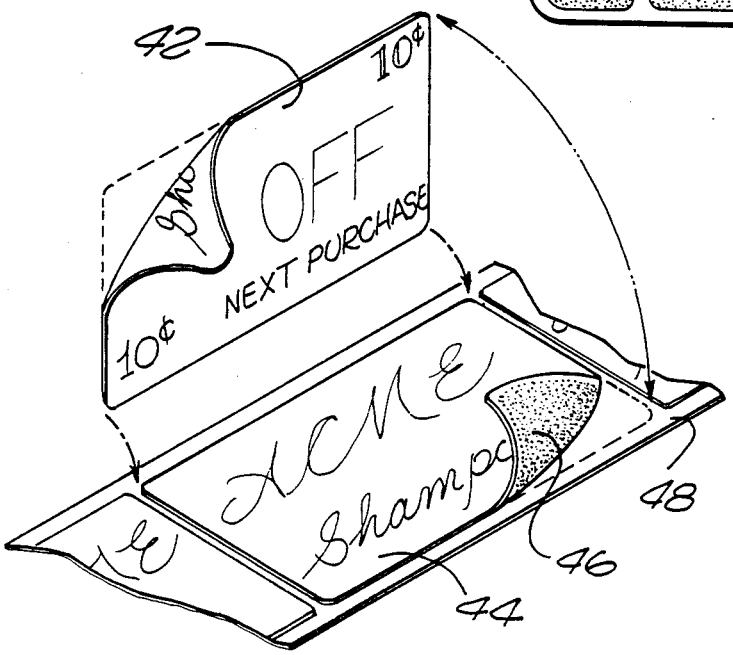
FIG. 3 shows a two layer label illustrating the principles of the invention.

Concerning FIG. 3, a two-layer label assembly is shown, with the outer label 42 having advertising material on its outer surface and promotional material, such as a "cents-off" coupon or a game piece on its inner surface. It is secured by water-soluble cement in a pattern, such as that shown in FIG. 2, to the base label 44, which has permanent adhesive 46 on its lower surface, in engagement with the backing web or strip 48. Of course, in accordance with normal practice, the surface of the backing web 48 is coated with silicone to permit easy peeling of the label assemblies from the backing web.

Figure 4:
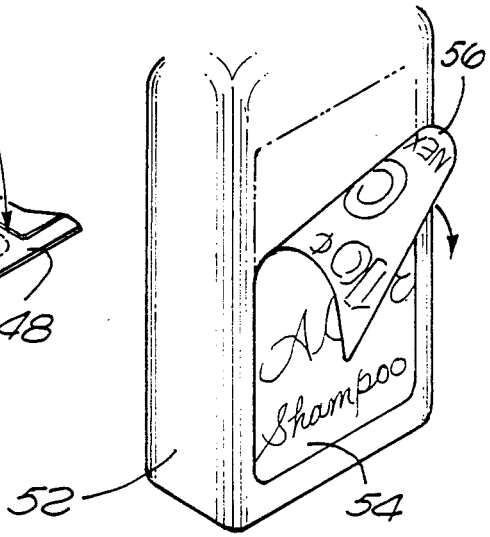
FIG. 4 shows a single layer label secured to a product container, in which the label is opaque, and the promotional material is printed on the concealed side of the label.

FIG. 4 shows a container 52 to which a single layer label 54 of opaque, water-resistant material is secured by water-soluble adhesive, preferably in a patterned configuration, on the inner surface 56 of the label 54. The outer surface of the opaque label 54 may be provided with advertising and product information, while the concealed inner surface has the promotional information including either a coupon, or a game piece, for specific examples.

In FIG. 5 the showings of "A", "B" and "C" are containers 62, 64 and 66 with labels 68, 70 and 72. The labels 68, 70 and 72 may take any of the forms as shown in FIGS. 1 through 4, and may be formed of one, two or three layers, as indicated in FIGS. 1 through 4 as described hereinabove.

Figure 6:
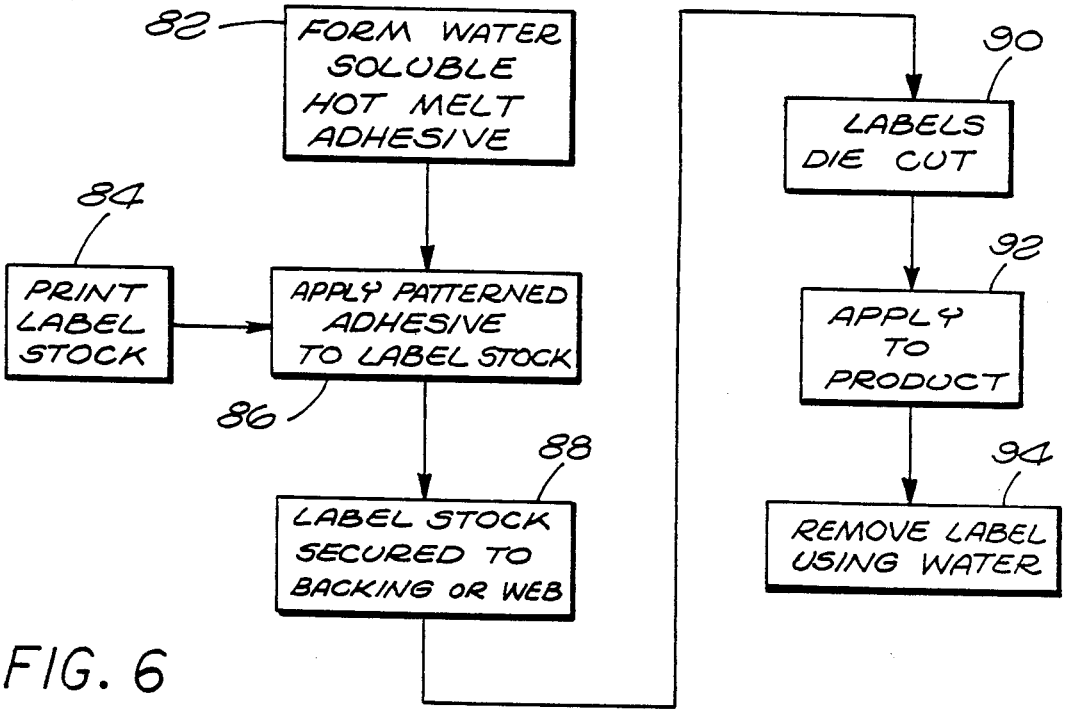
FIG. 6 shows a flow diagram of a method illustrating the present invention.

FIG. 6 is a step-by-step flow diagram relating to the method by which the labels are formed and used. More specifically, block 82 indicates the forming of the water-soluble, hot melt adhesive, and block 84 indicates the step of printing the label stock with waterproof ink, to provide the advertising and promotional information. Block 86 refers to the application of the patterned adhesive to the label stock material. Block 88 refers to securing the label stock material to the backing or web material. Block 90 refers to the step of forming labels by die-cutting the label stock material in accordance with normal label practices. The application of the labels to product by conventional labeling apparatus is indicated by block 92 in FIG. 6. This is the step of running the backing tape or web 12, as shown in FIG. 1, for example, over a peeling blade, so that the label extends forward and engages a product container, normally in a conveyor line configuration. Following the sale of the product, and taking the product to the location where it will be used, the outer label is removed, using water, as indicated by block 94, with the promotional information, such as the game piece or "cents-off" coupon, then being exposed.

Incidentally, it is to be understood that when either of the terms "promotional material" or "concealed promotional material" are used in the present specification or claims, reference is made to "cents-off" coupons, game pieces, or to other similar materials having some potential special value.

In conclusion, it is to be understood that the foregoing detailed description and the accompanying drawings illustrate the principles of the present invention. Minor variations or departures from the indicated constructions or method steps may be accomplished without departing from the spirit of the invention. Thus, by way of example and not of limitation, other adhesives and materials apart from the specific ones mentioned, may be used. The coating of the water-soluble adhesive may be either a full coating, or patterned as shown in FIG. 2. Instead of a self-contained game piece, the game pieces which are provided may require the purchase of a number of products, in order to complete the pattern of the game. Accordingly, the present invention is not limited to the precise arrangements as shown in the drawings, and as described hereinabove.

What is claimed is:

1. A secure, on-pack, promotional label assembly comprising:
   - a backing strip;
   - a coating of release material on said backing strip;
   - at least one base label bearing advertising printed material thereon, mounted on said backing strip;
   - a coating of permanent pressure-sensitive adhesive material on its outer surface;
   - water soluble adhesive means for securing said outer label to said base label; and
   - said assembly including promotional printed material and means for concealing said promotional material when said outer label is adhered to said base label;
   - whereby said outer label may only be removed by the applicaton of water thereto.

2. A secure, on-pack promotional label assembly as defined in claim 1 wherein a promotional label or coupon is mounted between said base label and said outer label.

3. A secure, on-pack promotional label assembly as defined in claim 1 wherein said water-soluble adhesive is patterned to facilitate removal of the outer label.

4. A secure, on-pack promotional label assembly as defined in claim 1 wherein said assembly includes a scratch-off type game piece.

5. A secure, on-pack promotional label asesmbly as defined in claim 1 wherein said assembly includes a "cents-off" coupon for use in purchasing additional products.

6. A secure, on-pack promotional label assembly as defined in claim 1 wherein said water-soluble adhesive is a hot melt water-soluble adhesive.

7. A secure, on-pack promotional label assembly as defined in claim 1 wherein said base label and said promotional printing material are formed of water-resistant material.

8. A secure, on-pack, promotional label assembly comprising:

a backing strip;

a coating of release material on said backing strip;

at least one label bearing advertising printed material on the front thereof, mounted on said backing strip;

a coating of adhesive mateiral on said label and facing said backing strip;

said label assembly including promotional printing material supported on said label assembly, and said label assembly including means for concealing said promotional material when viewed from the side of said label bearing advertising printed material;

said promotional material and the support therefor being waterpoof; and said assembly having means including water-soluble adhesive material for initially securing said label assembly when it is mounted on a product so that said promotional material is not exposed;

whereby said promotional material may only be exposed by the application of water to said water soluble adhesive.

9. A secure, on-pack, promotional label assembly as defined in claim 8 wherein said assembly includes a base label having a layer of permanent pressure-sensitive adhesive thereon, and an outer label secured to said base label by said water-soluble adhesive.

10. A secure, on-pack, promotional label assembly as defined in claim 9 wherein a third intermediate label layer mounted between said base and outer labels bears said promotional printing material.

11. A secure, on-pack, promotional label assembly as defined in claim 8 wherein said assembly is a single thickness opaque label with the promotional material on the underside thereof, and water soluble adhesive coated on the underside thereof for securing said label to the product.

12. A secure, on-pack promotional label assembly as defined in claim 8 wherein said water-soluble adhesive is patterned to facilitate removal thereof.

13. A secure, on-pack promotional label assembly as defined in claim 8 wherein said assembly includes a scratch-off type game piece.

14. A secure, on-pack promotional label assembly as defined in claim 8 wherein said assembly includes a "cents-off" coupon for use in purchasing additional products.

15. A secure, on-pack promotional label assembly as defined in claim 8 wherein said water-soluble adhesive is a hot melt water-soluble adhesive.

16. A secure, on-pack promotional label assembly as defined in claim 8 wherein the portion of said label assembly supporting said promotional material is formed of plastic sheet material.

17. A method comprising the steps of:

printing promotional material on substantially waterproof label sheet stock;

applying a hot melt, water-soluble permanent, pressure-sensitive adhesive to said label sheet stock with the label sheet stock moving in a predetermined direction, said adhesive being applied in a pattern to each label area with the pattern being interrupted both in said predetermined direction, and transverse thereto;

securing said label stock to a release coated backing web;

forming individual label assemblies from said label stock;

applying said label assemblies to product containers with the promotional material being concealed by at least one layer of said label stock; and subsequently exposing said promotional material by the application of water to said labels.

18. A method as defined in claim 17 including the additional steps of forming base label sheet material, coating said base label sheet material with permanent pressure-sensitive adhesive, and securing the label stock with the water soluble adhesive to the base label sheet, and the base label sheet to the backing web.

19. A method involving the use of promotional material concealed in label assemblies comprising the steps of:

printing promotional material on label sheet stock forming at least part of label assemblies;

applying a water-soluble, permanent adhesive to label sheet stock forming at least part of said label assemblies;

securing said label stock to a release coated backing web;

forming individual label assemblies from the label stock;

applying said label assemblies to product containers with the promotional material being concealed by at least one layer of said label stock; and subsequently exposing said promotional material by the application of water to said assemblies.

20. A method as defined in claim 19 including the additional steps of forming base label sheet material, coating said base label sheet material with permanent pressure-sensitive adhesive, and securing the label stock with the water soluble adhesive to the base label sheet, and the base label sheet to the backing web.

* * * * *